US011382810B2

(12) United States Patent
Silveira et al.

(10) Patent No.: US 11,382,810 B2
(45) Date of Patent: Jul. 12, 2022

(54) FOLD, RECLINE, AND TILT MECHANISMS FOR A PERSONAL MOBILITY VEHICLE

(71) Applicant: Sunrise Medical (US) LLC, Fresno, CA (US)

(72) Inventors: Daniel Silveira, Fresno, CA (US); Samuel D. Traxinger, Fresno, CA (US); Jefferey Bashian, Clovis, CA (US); Steven Alatorre, Fowler, CA (US)

(73) Assignee: Sunrise Medical (US) LLC, Fresno, CA (US)

( * ) Notice: Subject to any disclaimer, the term of this patent is extended or adjusted under 35 U.S.C. 154(b) by 350 days.

(21) Appl. No.: 16/819,000

(22) Filed: Mar. 13, 2020

(65) Prior Publication Data

US 2020/0289350 A1 Sep. 17, 2020

Related U.S. Application Data

(60) Provisional application No. 62/817,763, filed on Mar. 13, 2019.

(51) Int. Cl.

| | |
|---|---|
| ***A61G 5/10*** | (2006.01) |
| ***A61G 5/08*** | (2006.01) |
| ***A61G 5/12*** | (2006.01) |

(52) U.S. Cl.

CPC ..... *A61G 5/1067* (2013.01); *A61G 5/0858* (2016.11); *A61G 5/0866* (2016.11); *A61G 5/1075* (2013.01); *A61G 5/122* (2016.11)

(58) Field of Classification Search

CPC .... A61G 5/1067; A61G 5/122; A61G 5/0858; A61G 5/0866; A61G 5/1075; A61G 5/085; A61G 5/08

See application file for complete search history.

(56) References Cited

U.S. PATENT DOCUMENTS

| | | | | |
|---|---|---|---|---|
| 5,020,816 | A * | 6/1991 | Mulholland | A61G 5/08 280/42 |
| 6,938,911 | B1 * | 9/2005 | Shyu | A61G 5/08 280/250.1 |
| 7,419,176 | B2 * | 9/2008 | Perk | A61G 5/14 297/344.15 |
| 2007/0145723 | A1 * | 6/2007 | Kamara | A61G 5/1059 280/647 |
| 2009/0309336 | A1 * | 12/2009 | Hanson | A61G 5/085 280/647 |
| 2011/0006494 | A1 * | 1/2011 | Walker | A61G 5/08 280/7.17 |

* cited by examiner

*Primary Examiner* — Minnah L Seoh
*Assistant Examiner* — Harold Eric Pahlck, III
(74) *Attorney, Agent, or Firm* — MacMillan, Sobanski & Todd, LLC

(57) ABSTRACT

A personal mobility vehicle, such as a stroller, has spaced apart side frame assemblies that each include a backrest portion and a seat frame portion. The backrest portion is moveable to several recline positions relative to the seat frame portion by actuating a latching mechanism. The backrest portion and the base frame are both moveable to a folded position relative to the seat frame by actuating the same latching mechanism. The side frame assembly further has a tilt mechanism that permits the backrest and seat frames to move as a unit relative to the base frame.

14 Claims, 9 Drawing Sheets

FOLD, RECLINE, AND TILT MECHANISMS FOR A PERSONAL MOBILITY VEHICLE

CROSS-REFERENCE TO RELATED APPLICATIONS

This application claims the benefit of U.S. Provisional Application No. 62/817,763, filed Mar. 13, 2019, the disclosure of which is incorporated herein by reference.

BACKGROUND OF THE INVENTION

This invention relates in general to foldable and adjustable personal mobility vehicles. In particular, this invention relates to personal mobility vehicles, such as strollers and wheelchairs, that have an adjustable backrest and wheel support frame that can be easily manipulated into a compact package, suitable for transport.

Personal mobility vehicles, such a wheelchairs and strollers, have adjustable backrests that provide the ability to recline or tilt to provide a comfortable position for a seated user. Some of these vehicles are also foldable into a compact package so that they can be transported more easily. In a reclining adjustment, the backrest frame is angled relative to the seat frame. In a tilting adjustment, the backrest frame and seat frame are angled, as a unit, relative to the base frame or the support surface. In order to fold a stroller, for example, into the compact travel package the frame is unlatched and pivoted from a use position to a folded position. These adjustment mechanisms are typically separate elements that require separate manipulations.

For example, the backrest may be reclined or folded relative to the seat frame by removing a pin or other support member and moving the backrest to the desired position. To place the personal mobility vehicle in a folded position, the base frame may be unlatched by a separate locking device and articulated such that the wheels are drawn toward the frame and/or each other so that less space is consumed by the structure. The separate manipulations of these elements is cumbersome. Thus, it would be desirable to provide a personal mobility vehicle that permits backrest adjustment and also permits folding of the vehicle with a single actuation point, for at least each side frame structure. It would further be desirable to provide a tilt capability in conjunction with the single point recline and fold capability.

SUMMARY OF THE INVENTION

This invention relates to foldable and adjustable personal mobility vehicles. In particular, this invention relates to personal mobility vehicles, such as strollers and wheelchairs, that have an adjustable backrest and support frame that can be easily manipulated into a compact package, suitable for transport from a single actuation point.

A side frame assembly of a personal mobility vehicle includes a base frame assembly, a seat frame, a backrest cane, and a backrest link. The seat frame has a rail housing that supports a folding actuation rail and a recline adjustment rail for relative linear movement and concurrent linear movement. The folding actuation rail can be selectively fixed relative to the rail housing between a first position of the base frame assembly and a second position of the base frame assembly that is more compact than the first position. The backrest cane is pivotally attached to the seat frame. The backrest link pivotally attached to the backrest cane and pivotally attached to the recline adjustment rail such that pivoting movement of the backrest cane moves the folding actuation rail between the first and second positions.

The first position of the side frame assembly defines a use position and the second position defines a folded position of the backrest cane and the base frame assembly.

The recline adjustment rail defines a plurality of recline adjustment positions of the backrest cane relative to the seat frame. One of the seat frame or the rail housing supports a latch pin for relative movement between a recline enabling position and a folding enabling position. The latch pin engages the folding actuation rail and the recline adjustment rail such that when the latch pin is moved to the recline enabling position the backrest cane is enabled to move the recline actuation rail into the plurality of recline positions. When the latch pin is moved to the folding enabling position, the recline adjustment rail moves the folding actuation rail between the first and second positions. The backrest cane supports a handle that moves the latch pin between the recline enabling position and the folding enabling position.

The folding actuation rail includes a recline trigger and the recline actuation rail has a fold return detent, the recline trigger engages the fold return detent to enable the recline actuation rail to move the folding actuation rail from the second position to the first position. The rail housing includes a trip pin that releases the recline trigger from the fold return detent when the folding actuation rail is moved to the first position.

The base frame assembly has a front support link pivotally connected to one of the seat frame or the rail housing and a rear link is pivotally connected to the one of the seat frame or the rail housing. The front support link and the rear support link are pivotally coupled together to concurrently move between the first position and the second position in response to the movement of the folding actuation rail. A tilt link is pivotally connected between the folding actuation rail and the rear support link. The tilt link includes a plurality of tilt positioning apertures that define a plurality of tilt positions of the seat frame and backrest cane relative to a support surface. The plurality of tilt positioning apertures engage at least one aperture on the rear support link to define the plurality of tilt positions.

The front support link includes a front wheel and the rear support link includes a rear wheel. The front support link and the rear support link are pivotally coupled through a connecting link. At least one cross member mount is supported on one of a tilt link pivot or the connecting link such that a cross member is attached to the cross member mount and connected to a second side frame assembly to define the personal mobility vehicle.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
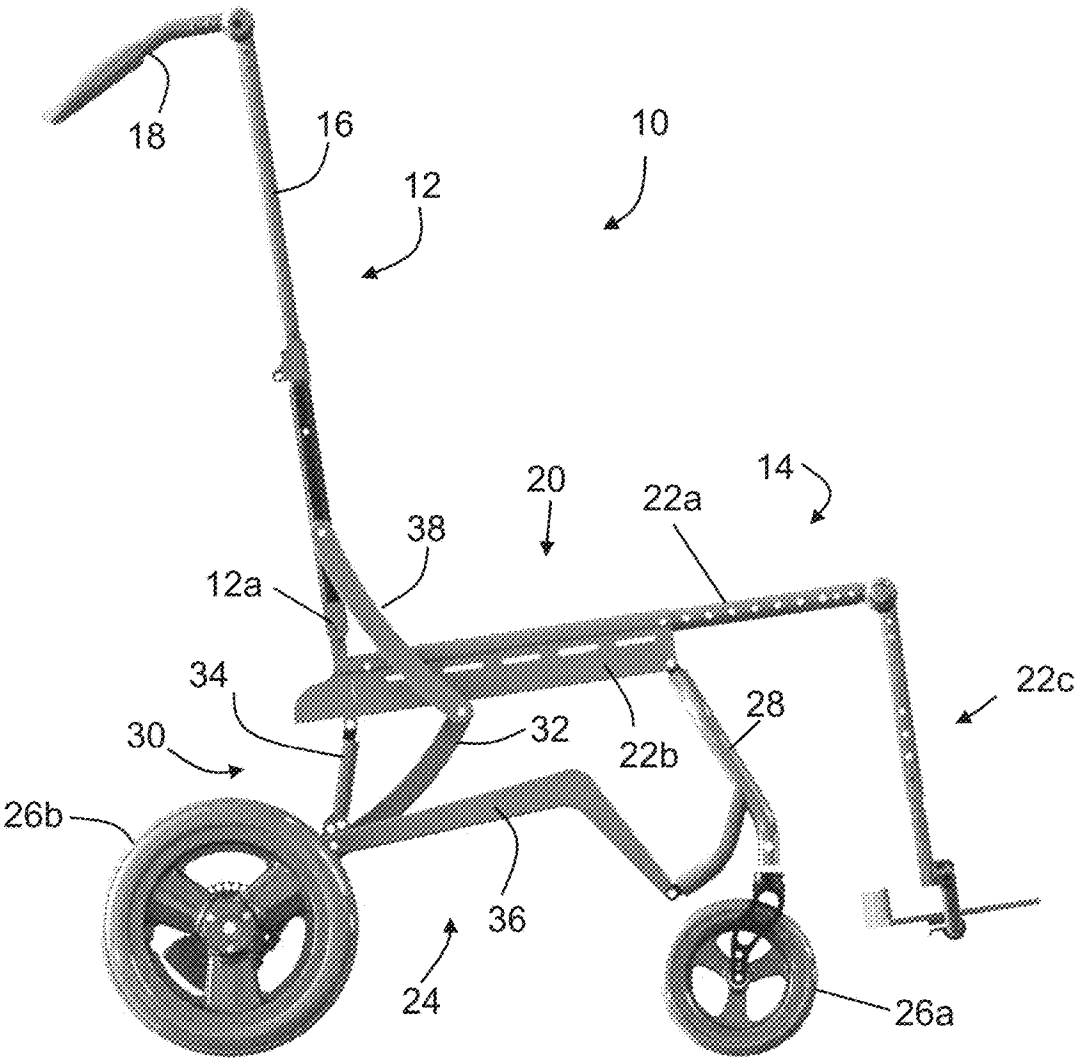
FIG. 1 is an elevation view of an embodiment of a personal mobility vehicle having a tilt and folding mechanism in accordance with the invention.

Referring now to the drawings, there is illustrated in FIG. 1 a personal mobility vehicle 10 having a recline and fold mechanism and a tilt mechanism in accordance with the invention. Though shown and described in the context of a stroller, the mechanisms described herein may be used on any type of personal mobility vehicle or seating device, such as for example a wheelchair or a folding chair. The stroller 10 is further shown and described in the context of a single side frame, though it should be understood that the stroller comprises two side frames that form a complete stroller unit. The stroller 10 is illustrated without seat and backrest cushions or other user interfaces, such as arm rests and head rests in order to clearly show the operation of the invention.

Figure 8:
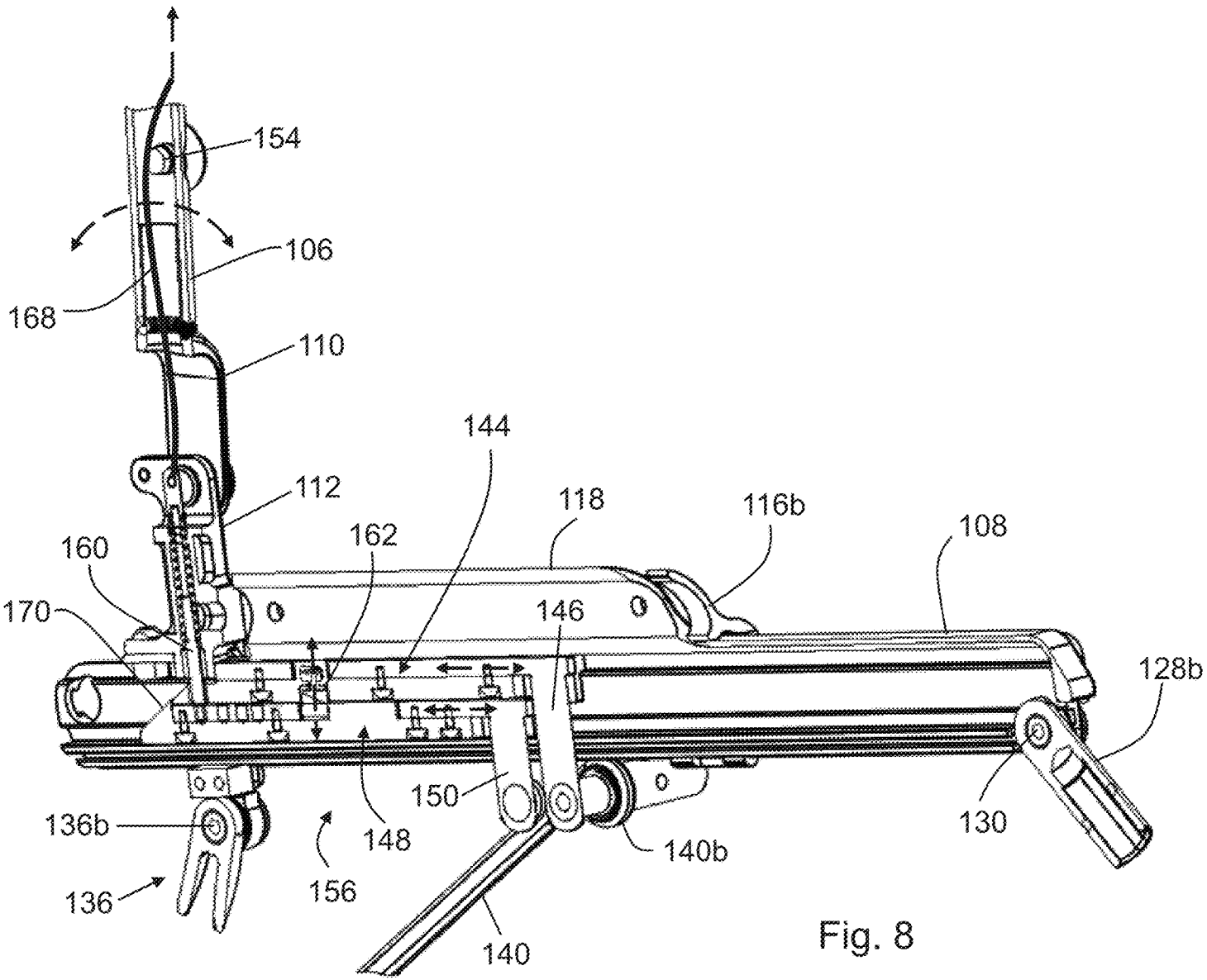
FIG. 8 is a cross-sectional, perspective view of the recline and fold mechanism in accordance with the invention.
Figure 9:
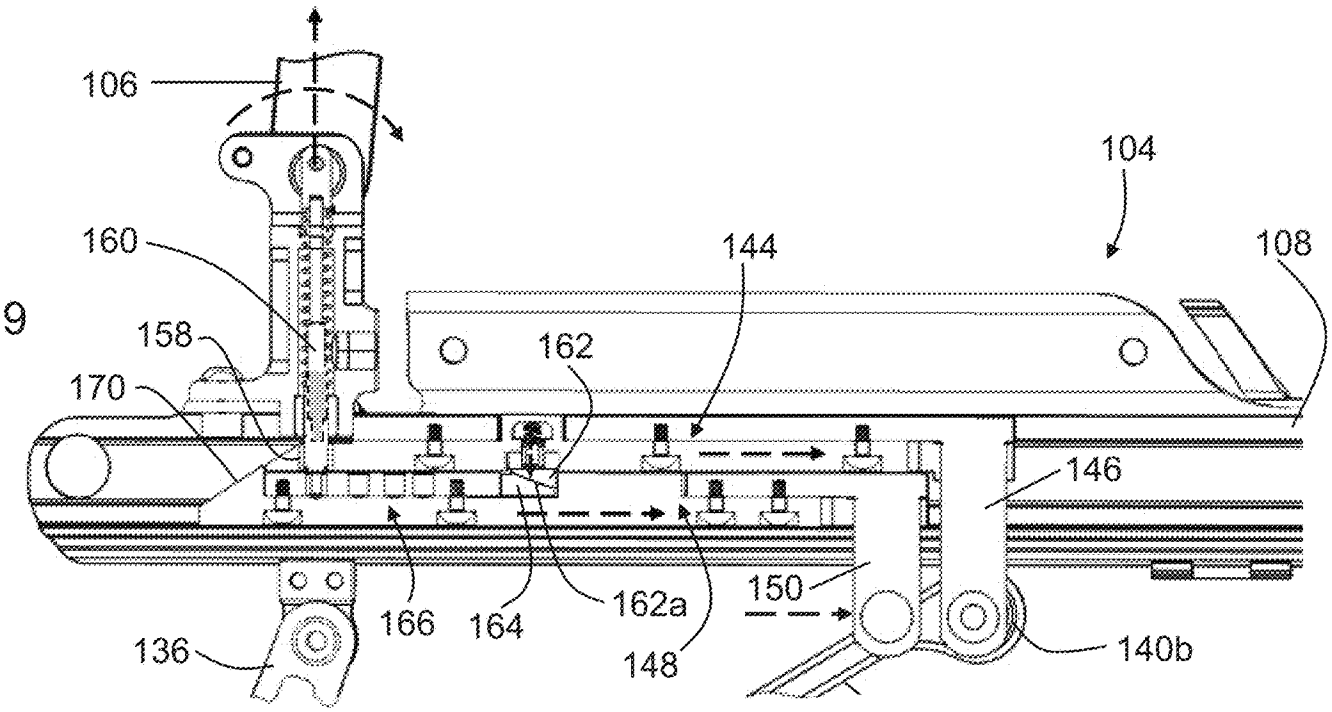
FIG. 9 is a cross-sectional, elevation view of the recline and fold mechanism of FIG. 8 with the backrest assembly in a use position.
Figure 10:
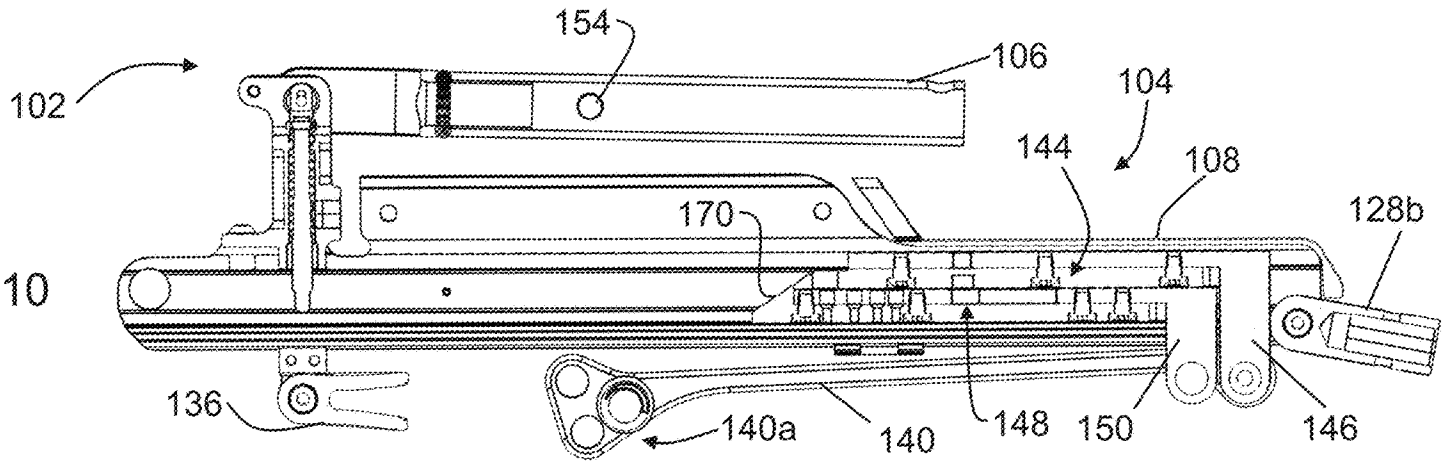
FIG. 10 is a cross sectional, elevation view of the recline and fold mechanism of FIG. 8 with the backrest assembly in a fully folded position.

The stroller 10 includes a backrest assembly 12 and a seat assembly 14. The backrest assembly 12 includes a backrest frame having spaced apart backrest canes 16, representing right and left sides of the stroller, and an attendant handle 18. The backrest canes are each pivotally attached to the seat assembly 14 at a backrest pivot 12*a*. In one embodiment, the handle 18 connects both canes 16, though each cane may have a separate handle. In one embodiment, the handle 18 is pivotally mounted to the canes 16 in order to actuate a recline and fold mechanism which will be described in detail below. Alternatively, the recline and fold mechanism may be actuated in any suitable manner including by a powered actuator or another mechanical linkage, cable, or mechanism. The seat assembly 14 includes a seat frame, shown generally at 20, that may have an adjustment frame 22*a* defining a plurality of adjustment points and a rail housing 22*b* supporting the recline and fold mechanism. The adjustment frame 22*a* and the rail housing 22*b* may be formed in a single seat frame structure as shown in FIGS. 2-13C or may be separate elements as shown in FIG. 1. The rail housing 22*b* supports two slide rails, as shown in FIGS. 8-10, that slide longitudinally relative to the rail housing 22*b* and relative to each other to transfer movement of the backrest assembly to either a reclining movement or a folding movement, as will be described below in detail. A legrest or foot board assembly 22*c* may be supported by the adjustment frame 22*a* or the rail housing 22*b*.

The stroller 10 includes a base frame 24 that supports front and back wheels 26*a* and 26*b*, respectively. The front wheels 26*a* are illustrated as caster wheels though they may be fixed wheels, mounted separately or coupled together by an axle (not shown). The base frame 24 includes a front support link 28 that supports the front wheel 26*a* and a rear support linkage, shown generally at 30. The rear support linkage 30 includes a tilt link 32 and a rear frame link 34, that supports the rear wheel 26*b*. A connecting link 36 is pivotally coupled to the front support link 28 and the rear frame link 34. The backrest canes 16 are each connected to one of the slide rails within the rail housing, as shown in FIGS. 8-10, by a backrest link 38. The tilt link 32 is pivotally connected to the other slide rail at a first end and to the rear frame link 34 at a second end. The operation of the recline and fold mechanism will be described in the context of FIGS. 2-12B, though the embodiment of FIG. 1 operates in a similar manner.

Figures 2, 3:
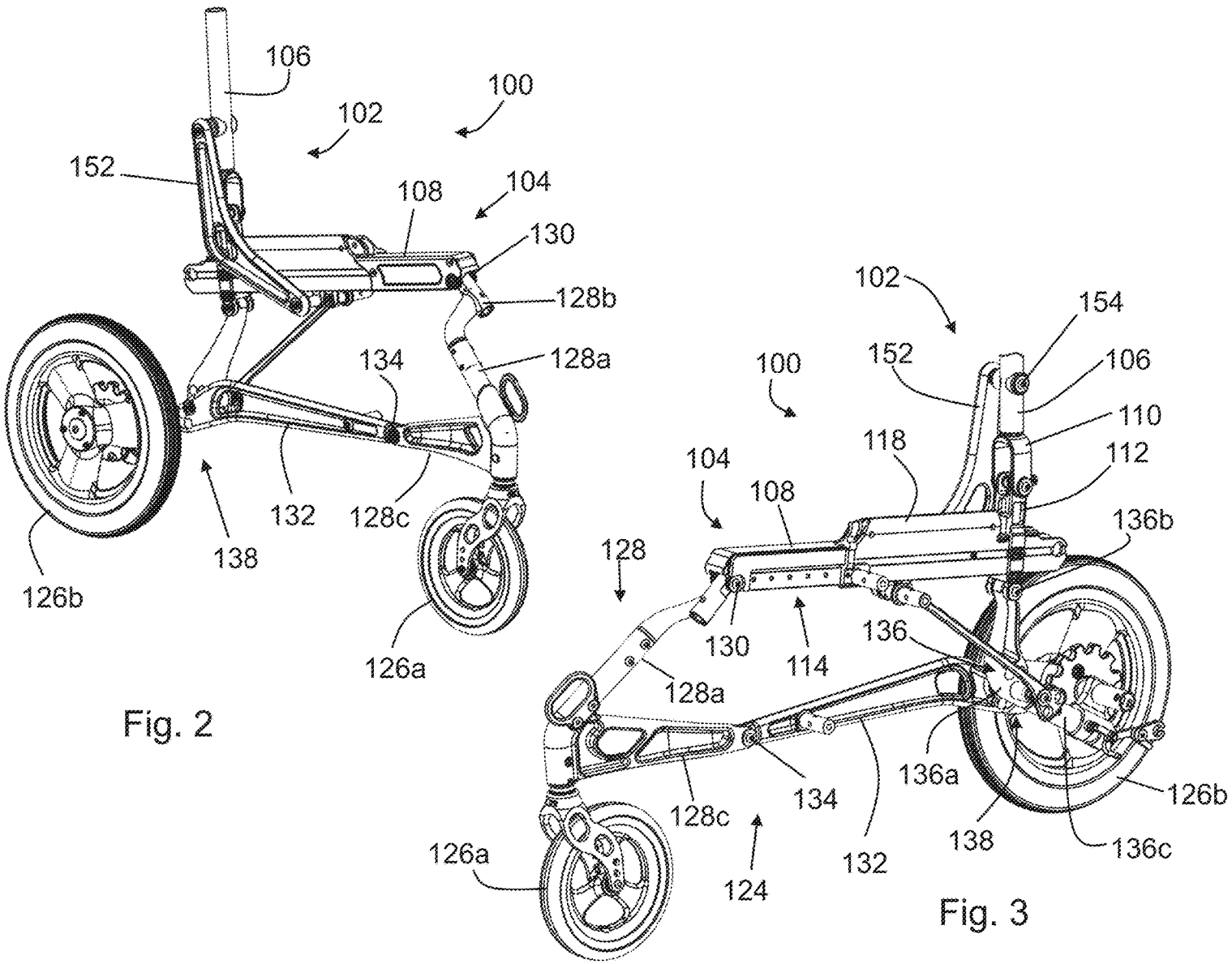
FIG. 2 is a perspective view of an outwardly positioned surface of a side frame assembly of a personal mobility vehicle similar to FIG. 1.
FIG. 3 is a perspective view of an inwardly positioned surface of the side frame assembly of FIG. 2.

Referring now to FIGS. 2 and 3, there is illustrated a second embodiment of a stroller having a side frame assembly, shown generally at 100. The side frame 100 comprises a backrest frame assembly, shown generally at 102, and a seat frame assembly, shown generally at 104. The side frame 100 is illustrated as a right side frame which is configured to be connected to a mirror image left side frame to form the stroller. The backrest frame assembly 102 includes a backrest cane or backrest tube 106 illustrated as a hollow tube though such is not required. The backrest cane 106 pivotally connects to a rail housing 108 of the seat frame assembly 104 by way of a backrest clevis yoke 110. In the illustrated embodiment, a rail clevis yoke 112 is fixed to the rail housing 108 of the seat frame assembly 104 and pivotally connected to the backrest clevis yoke 110. Alternatively, the backrest clevis yoke 110 may connect directly to a portion of the rail housing 108.

The seat frame assembly 104 includes an adjustment section 114 having a dovetail or other guiding element 114*a* and plurality of adjustment points or apertures 114*b* to permit a cross tube support 116 to be positioned to support different length seating structures. The cross tube support 116 has a cross member mount 116*a* configured to permit attachment of a cross member (not shown) between the right to left side frame assemblies. A seat mount 118 locates and supports different seating structures. The cross tube support 116 may also include a seat support 116*b* to support a portion of the seating structure that extends along the seat frame assembly 104. The rail housing 108 includes a trip pin 120 that extends into the housing, as will be described below. A rear frame link pivot support 122 attaches to the seat frame 104 and may be integrally formed with the rail clevis yoke 112 or may be a separately mounted structure.

A base frame, shown generally at 124, includes a front caster wheel assembly 126*a* connected to a front support link 128. The front support link 128 includes an upper arm 128*a* that is pivotally connected to the seat frame 104 by a front arm pivot 130. A legrest support 128*b* may extend from the upper arm 128*a* to support a legrest or foot board structure, similar to that shown in FIG. 1. The front support link 128 may include a lower arm 128*c* extending rearward. The lower arm 128*c* is pivotally connected to a connecting link 132 by an interconnecting pivot 134 that links a front portion of the base frame 124 to a rear portion. The connecting link 132 is pivotally connected to a rear link 136 at a suspension pivot point, shown generally at 138. In the illustrated embodiment, the suspension pivot point 138 of the connecting link 132 includes a plurality of pivot points to permit adjustment of how the user's weight is applied to the base frame 124. The connecting link 132 may also include a cross member mount similar to cross member mount 116*a*.

The rear link 136 is illustrated having a "boomerang" or angled shape and the connecting link 132 pivotally attaches at the elbow or mid-point pivot 136*a*. The mid-point pivot 136*a* may include a plurality of pivot apertures to provide additional adjustments to the base frame 124. Alternatively, the rear link 136 may have a different geometric shape including straight. The rear link 136 is pivotally mounted to the rear frame link pivot support 122 at an upper link pivot 136*b* and supports a rear wheel 126*b* at a lower end 136*c*. The boomerang shape of the rear link 136 and rearward extending configuration of the lower end 136*c* creates an "over center" locking condition that assists in stabilizing the stroller and recline and fold mechanism.

Figure 11B:
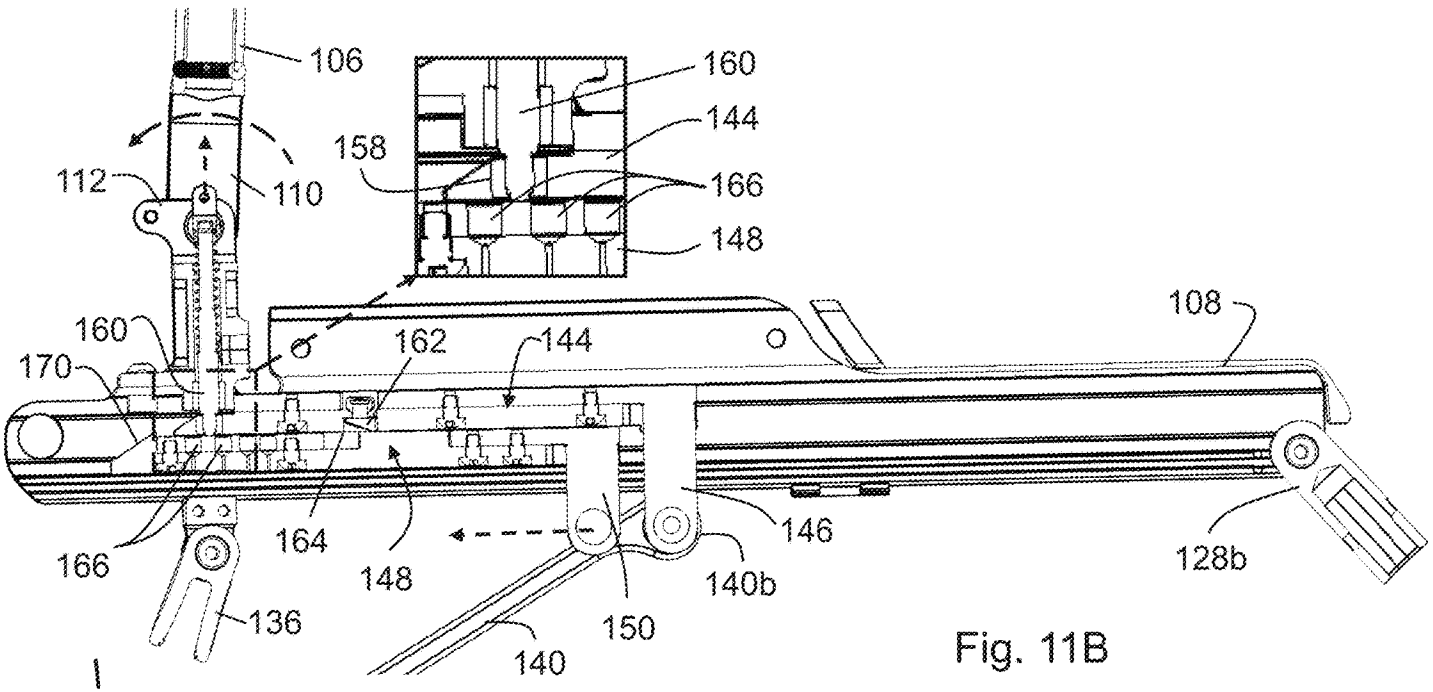
FIG. 11B is an enlarged, elevation view, in cross-section, showing the recline and fold mechanism in the first recline angle.
Figure 11A:
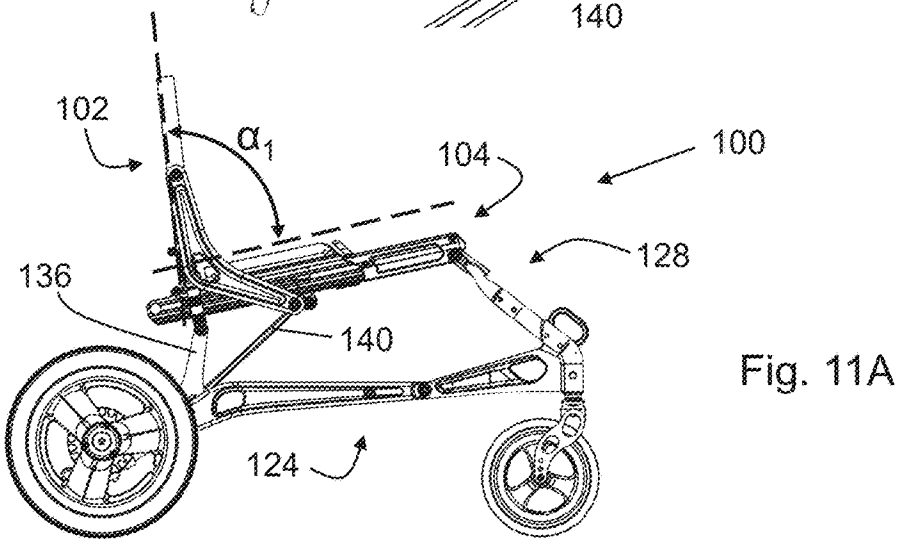
FIG. 11A is an elevation view of the side frame assembly showing the backrest at a first recline angle.
Figure 12B:
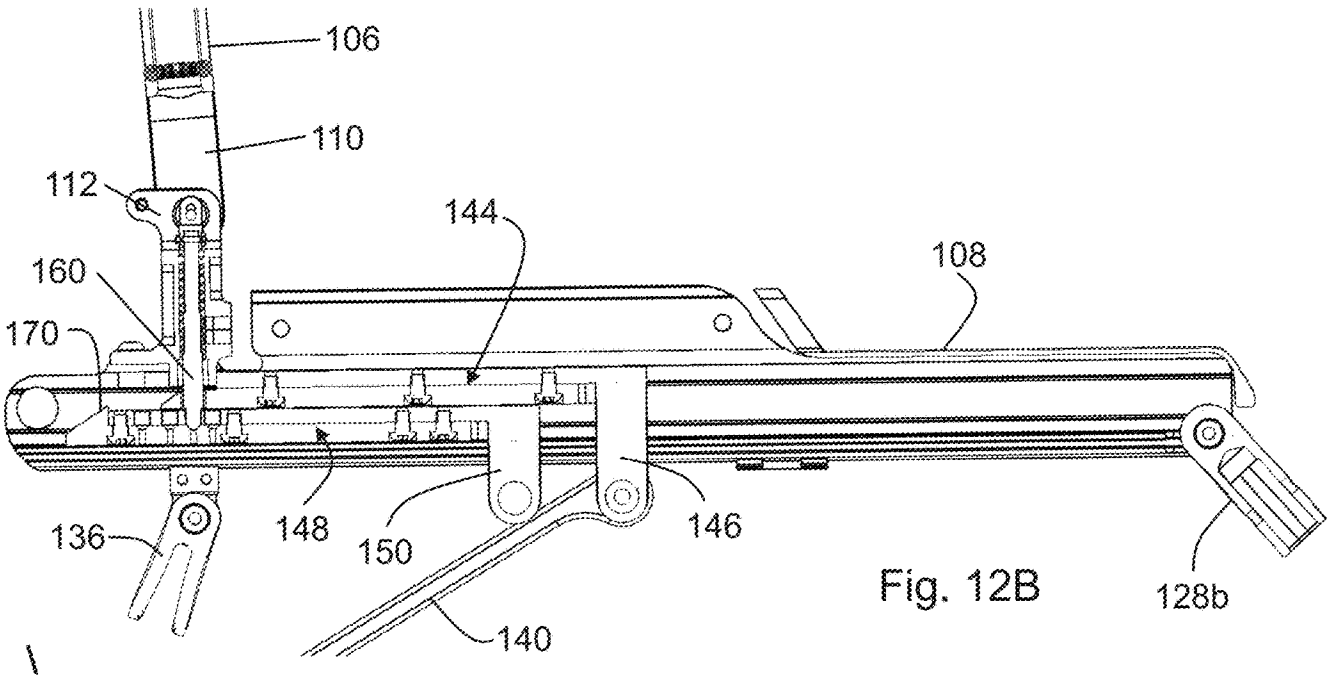
FIG. 12B is an enlarged, elevation view, in cross-section, showing the recline and fold mechanism in the second recline angle.
Figure 12A:
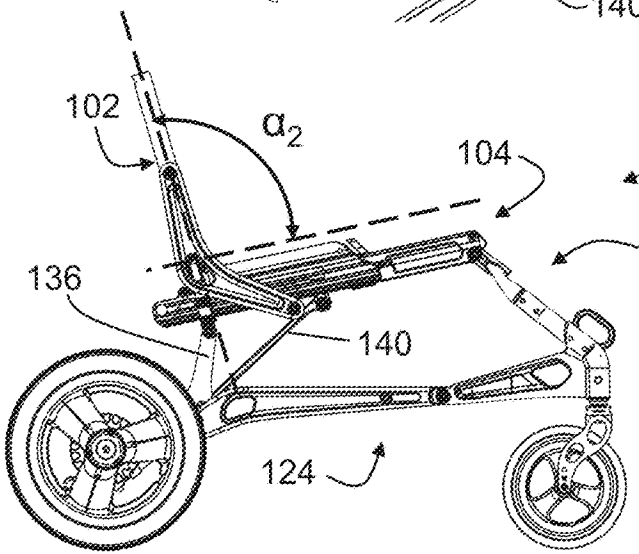
FIG. 12A is an elevation view of the side frame assembly showing the backrest at a second recline angle.
Figures 13A, 13B, 13C:
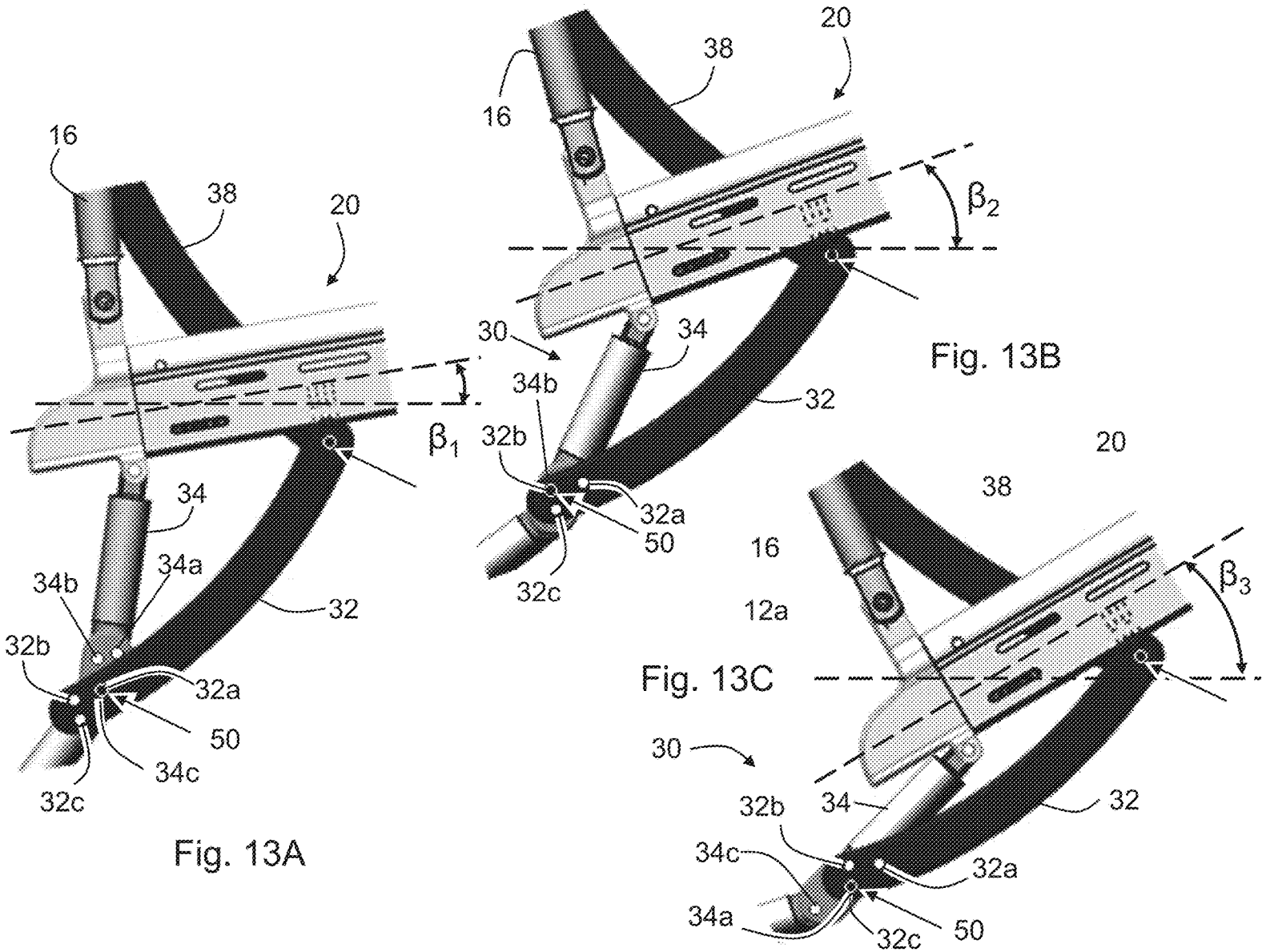
FIG. 13A is an enlarged, elevation view of a backrest and seat frame assembly in a first tilt position.
FIG. 13B is an enlarged, elevation view of a backrest and seat frame assembly in a second tilt position.
FIG. 13C is an enlarged, elevation view of a backrest and seat frame assembly in a third tilt position.

A tilt link 140 is pivotally mounted at a lower end 140*a* to the rear link 136. In the illustrated embodiment, the tilt link lower end 140*a* pivotally attaches to the mid-point pivot 136*a* and further includes a plurality of tilt adjustment apertures 142 to adjust the tilt angle of the seat and backrest assembly, as shown in FIGS. 7 and 13A-13C. Matching the different apertures of the lower end 140*a* to different apertures of the mid-point pivot 136*a* of the rear link 136 provides a range of tilt adjustment to the seat and backrest assembly. As shown in FIGS. 13A-13C, "tilt" is an adjustment of the seat and backrest together as a unit relative to the support surface. "Recline" is an adjustment where the backrest angle is adjusted relative to the seating surface, as shown in FIGS. 11A and 12A.

The upper end 140*b* of the tilt link 140 is pivotally connected to a folding actuation rail, shown generally at 144 in FIG. 8. The upper end 140*b* may also include a cross member mount similar to cross member mount 116*a*. The folding actuation rail 144 is supported for linear movement relative to the rail housing 108 and may include linear bearing elements if so desired. A tilt link mounting arm 146 extends from the forward end of the folding actuation rail 144 to below the rail housing 108 where the tilt link upper end 140*b* is pivotally attached. A recline adjustment rail 148 is also supported for linear movement relative to the rail housing 108 and also relative to the folding actuation rail 144. A recline mounting arm 150 extends from the forward end of the recline adjustment rail 148 and pivotally connects to a backrest link 152 at a first end. The backrest link 152 is pivotally connected to the backrest frame at a pivot point 154. The pivot point 154 is illustrated as connected to the backrest cane 106 though other locations on the backrest frame may be utilized. The recline adjustment rail 148 and the folding actuation rail 144 form a recline and folding mechanism 156 and are illustrated as positioned above and below each other. Alternatively the rails 144 and 148 may be positioned in a side-by-side relationship.

The folding actuation rail 144 includes a fold position locking aperture 158 that permits a latch pin 160 to pass through. The folding actuation rail 144 also includes a recline trigger 162 that is resiliently biased toward a fold return detent 164 formed in the recline adjustment rail 148. The recline trigger 162 engages the fold return detent 164 as the rails 144 and 148 are moved together to fold the backrest frame assembly 102 toward the seat frame assembly 104. The recline trigger 162 causes the folding actuation rail 144 to be drawn rearward with the recline adjustment rail during an unfolding maneuver where the backrest assembly is returned to a use position (backrest assembly positioned to accept a seated user). As the backrest frame assembly 102 is brought to the upright position, the 152 backrest link draws the recline adjustment rail 148 and the folding actuation rail 144 rearward in the rail housing 108. In the use position, the recline trigger 162 is disengaged from the return detent 164 by the trip pin 120 contacting the inclined surface 162*a* of the recline trigger 162, shown in FIG. 7.

The recline adjustment rail 148 includes a plurality of recline angle adjustment apertures 166 that define angular position of the backrest frame assembly 102 relative to the seat frame assembly 104. Each aperture 166 is configured to receive the latch pin 160 to fix the backrest frame assembly in a desired recline position. Any number of recline angle adjustment apertures 166 may be provided to create the desired recline adjustment increments. The latch pin 160 is resiliently biased into engagement with the folding actuation rail 144 and the recline adjustment rail 148 as shown in FIG. 9.

Figure 4:
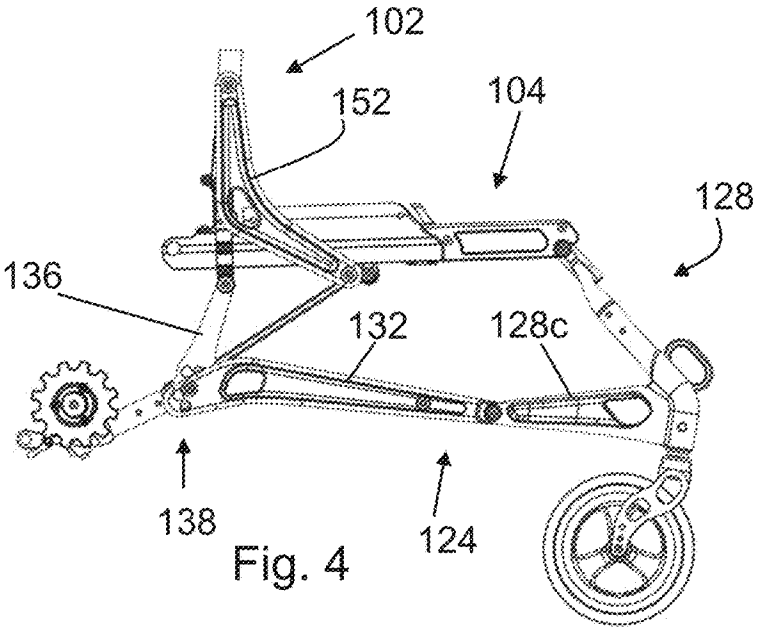
FIG. 4 is an elevation view of the side frame assembly of FIG. 2 in a use position.
Figure 6:
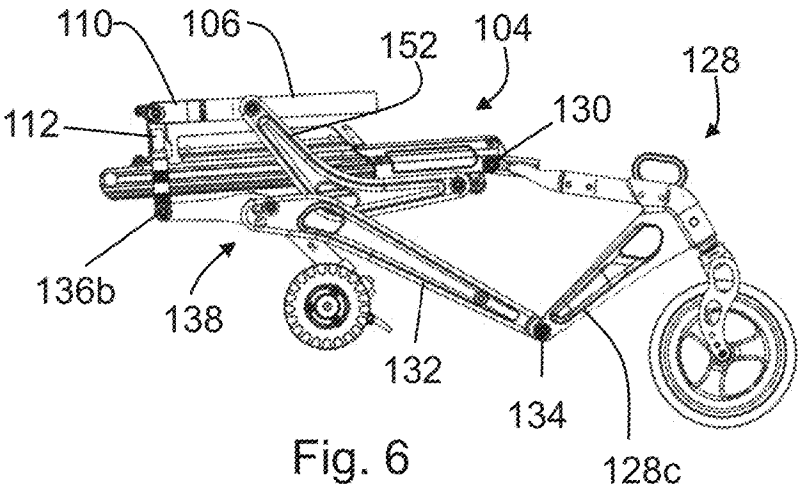
FIG. 6 is an elevation view of the side frame assembly of FIG. 4 in a fully folded position.
Figure 5:
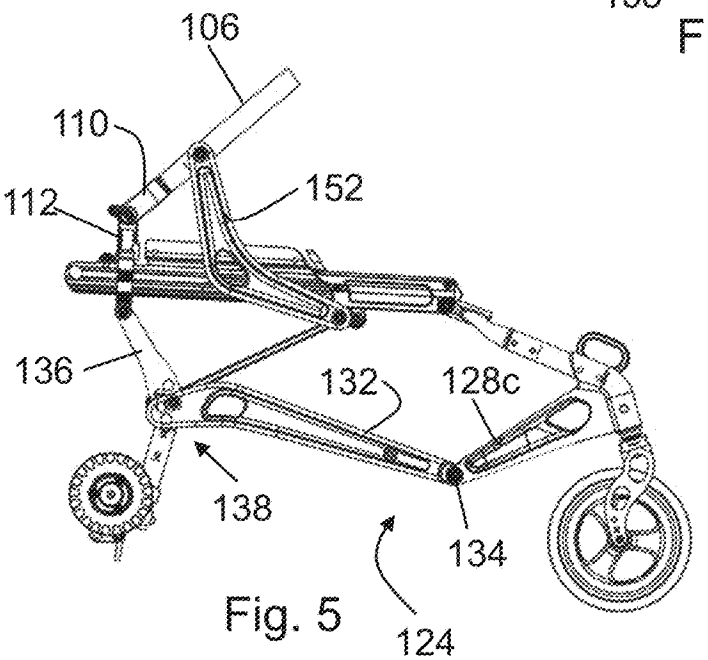
FIG. 5 is an elevation view of the side frame assembly of FIG. 4 in partially folded position.
Figure 7:
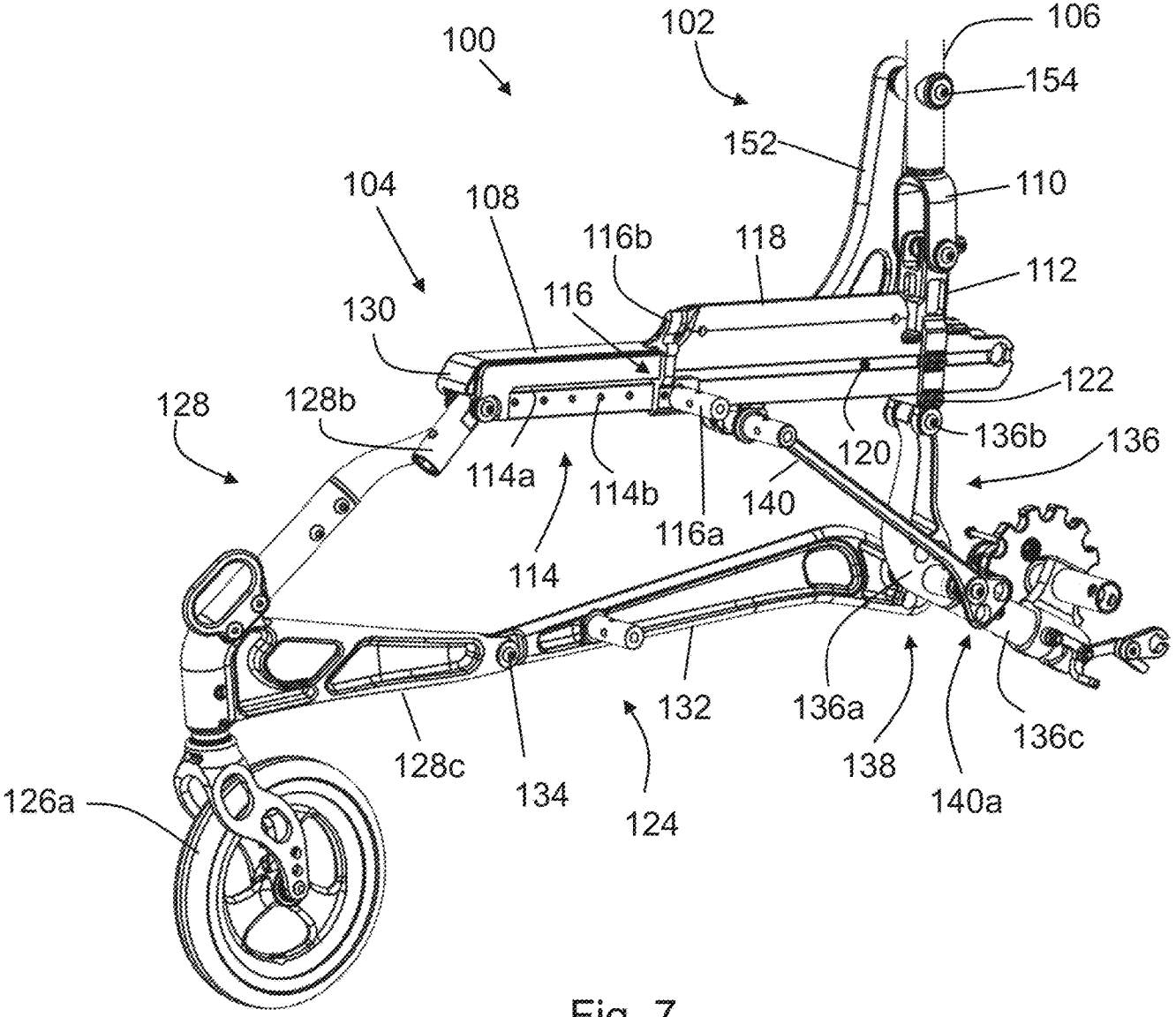
FIG. 7 is an enlarged view of FIG. 3.

FIGS. 4-6 illustrate the motion of the backrest and seat frame assemblies 102 and 104, and the base frame 124 during a folding operation. In order to fold the backrest frame assembly 102 toward the seat frame assembly 104, as shown in FIG. 10, the latch pin 160 is pulled out of engagement with one of the plurality of angle adjustment apertures 166 and the fold position locking aperture 158. The latch pin 160 is actuated by cable or rod 168 that is operated by a handle, such as handle 18. Alternatively, the latch pin 160 may be actuated by a solenoid or other mechanism. The recline adjustment rail 148 is moved forward by the backrest link 152 acting on the recline mounting arm 150. A stop 170 contacts the end of the folding actuation rail 144 causing both rails to move together toward the front of the rail housing 108.

The tilt link mounting arm 146 moves the tilt link 140 forward and upward toward the rail housing 108 in a clockwise motion when viewing the outside of the right side frame assembly 100. The tilt link 140 pulls on the mid-point pivot 136*a* causing the rear link 136 to pivot counterclockwise about the upper link pivot 136*b*. The rear link 136 can be drawn into contact with the seat frame assembly 102 to create a compact package for easy transport. To return the backrest frame assembly 102 to the upright position, the backrest is rotated counterclockwise until the latch pin 160 is moved upward by the inclined rear surfaces of the recline adjustment rail 148 and the folding actuation rail 144 and brought into alignment with the fold position locking aperture 158 and at least the first aperture of the plurality of recline angle adjustment apertures 166. When the backrest, seat and base frames are in a use position, the weight of the stroller and the user cause the rear wheel 126*b* to be biased in a rearward direction (clockwise as shown in FIGS. 2 and 4) which is resisted by the tilt link 140 and the folding actuation rail 144. The tilt link 140 draws the folding actuation rail 144 into a stop defining a rearward end of travel of the rail support channels of the rail housing 108. This prevents the latch pin 160 from binding in the apertures 158 and 166 so that the pin is easily withdrawn.

Referring now to FIGS. 11A-12B, a backrest reclining operation sequence is depicted. In the reclining operation, the latch pin 160 is withdrawn from the engaged one of the plurality of recline angle adjustment apertures 166 but remains engaged in the fold position locking aperture 158. The recline adjustment rail 148 is free to move relative to the folding actuation rail 144 and the rail housing 108. The folding actuation rail 148 is maintained in position by the user and stroller weight acting on the base frame linkages and by the latch pin 160 as a failsafe. The recline trigger 162 is withdrawn from the detent 164 by the trip pin 120 also permitting movement of the recline adjustment rail 148. As the backrest frame assembly 102 is pivoted relative to the seat frame assembly 104, the backrest link 152 slides the recline adjustment rail 148 to align to latch pin 160 with the desired aperture 166. Since the latch pin is biased into engagement with the apertures 158 and 166 by the resilient member, the backrest can be moved to each of the apertures 166 in an indexed manner by permitting the latch pin to contact the surface of the rail 148 between the apertures. Thus, the backrest may be moved from a first recline position of angle $\alpha_1$ to a second recline position $\alpha_2$ in a stepwise sequence. Holding the latch pin out of engagement permits free movement of the backrest through the range of recline angles. During the reclining operation, the base frame stays in the same position.

Referring now to FIGS. 13A-13C, a tilt adjustment is illustrated with the stroller embodiment of FIG. 1. However, it should be appreciated that the same adjustments may be made to the embodiment of a stroller having side frames 100. Tilt adjustment is realized by aligning apertures of the tilt link 32, such as apertures 32*a*, 32*b*, or 32*c* with apertures of the rear frame link 34, such as apertures 34*a*, 34*b*, or 34*c*. A tilt pin 50 is inserted into the aligned apertures to provide the desired tilt angle.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A side frame assembly of a personal mobility vehicle comprising:

a base frame assembly;

a seat frame having a rail housing that supports a folding actuation rail and a recline adjustment rail for relative linear movement and concurrent linear movement, the folding actuation rail configured to be selectively fixed relative to the rail housing between a first position of the base frame assembly and a second position of the base frame assembly that is more compact than the first position;

a backrest cane pivotally attached to the seat frame;

a backrest link pivotally attached to the backrest cane and pivotally attached to the recline adjustment rail such that pivoting movement of the backrest cane moves the folding actuation rail between the first and second positions.

2. The side frame assembly of claim 1 wherein the first position defines a use position and the second position defines a folded position of the backrest cane and the base frame assembly.

3. The side frame assembly of claim 1 wherein the recline adjustment rail defines a plurality of recline adjustment positions of the backrest cane relative to the seat frame.

4. The side frame assembly of claim 3 wherein one of the seat frame or the rail housing supports a latch pin for relative movement between a recline enabling position and a folding enabling position, the latch pin engages the folding actuation rail and the recline adjustment rail such that when the latch pin is moved to the recline enabling position the backrest cane is enabled to move the recline actuation rail into the plurality of recline positions.

5. The side frame assembly of claim 4 wherein when the latch pin is moved to the folding enabling position, the recline adjustment rail moves the folding actuation rail between the first and second positions.

6. The side frame assembly of claim 4 wherein the backrest cane supports a handle that moves the latch pin between the recline enabling position and the folding enabling position.

7. The side frame assembly of claim 1 wherein the folding actuation rail includes a recline trigger and the recline actuation rail has a fold return detent, the recline trigger engages the fold return detent to enable the recline actuation rail to move the folding actuation rail from the second position to the first position.

8. The side frame assembly of claim 7 wherein the rail housing includes a trip pin that releases the recline trigger from the fold return detent when the folding actuation rail is moved to the first position.

9. The side frame assembly of claim 1 wherein the base frame assembly has a front support link pivotally connected to one of the seat frame or the rail housing and a rear link pivotally connected to the one of the seat frame or the rail housing, the front support link and the rear support link pivotally coupled together to concurrently move between the first position and the second position in response to the movement of the folding actuation rail.

10. The side frame assembly of claim 9 wherein a tilt link is pivotally connected between the folding actuation rail and the rear support link.

11. The side frame assembly of claim 10 wherein the tilt link includes a plurality of tilt positioning apertures that define a plurality of tilt positions of the seat frame and backrest cane relative to a support surface.

12. The side frame assembly of claim 11 wherein the plurality of tilt positioning apertures engage at least one aperture on the rear support link to define the plurality of tilt positions.

13. The side frame assembly of claim 9 wherein the front support link includes a front wheel and the rear support link includes a rear wheel, the front support link and the rear support link are pivotally coupled through a connecting link.

14. The side frame assembly of claim 13 wherein at least one cross member mount is supported on one of a tilt link pivot or the connecting link such that a cross member is attached to the cross member mount and connected to a second side frame assembly to define the personal mobility vehicle.

* * * * *